US009851658B2

(12) United States Patent
Inada et al.

(10) Patent No.: US 9,851,658 B2
(45) Date of Patent: Dec. 26, 2017

(54) DEVELOPING DEVICE AND IMAGE FORMING APPARATUS

(71) Applicant: Konica Minolta, Inc., Chiyoda-ku, Tokyo (JP)

(72) Inventors: Yasuyuki Inada, Toyohashi (JP); Yu Mukobayashi, Nagoya (JP); Yuusuke Mandai, Kyoto (JP); Kanji Nakayama, Toyokawa (JP); Shinichi Yoshimoto, Toyohashi (JP); Junji Kanda, Toyota (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/931,705

(22) Filed: Nov. 3, 2015

(65) Prior Publication Data

US 2016/0139541 A1 May 19, 2016

(30) Foreign Application Priority Data

Nov. 19, 2014 (JP) ..... 2014-234920

(51) Int. Cl.
*G03G 15/08* (2006.01)

(52) U.S. Cl.
CPC ..... *G03G 15/0891* (2013.01); *G03G 15/0893* (2013.01)

(58) Field of Classification Search
CPC ..... G03G 2215/0833
See application file for complete search history.

(56) References Cited

U.S. PATENT DOCUMENTS

2006/0216067 A1* 9/2006 Okoshi ..... G03G 15/0875 399/258
2007/0183815 A1* 8/2007 Himes ..... G03G 15/0877 399/262

(Continued)

FOREIGN PATENT DOCUMENTS

JP 2000-66500 3/2000
JP 2001228711 A * 8/2001

(Continued)

OTHER PUBLICATIONS

Machine translation of Tokimatsu (2001).*

(Continued)

*Primary Examiner* — Sevan A Aydin
(74) *Attorney, Agent, or Firm* — Buchanan Ingersoll & Rooney PC

(57) ABSTRACT

A developing device includes a developer carrying member and first and second conveyance members. The first conveyance member conveys a developer in a first direction through a first conveyance path to the developer carrying member. The second conveyance member conveys the developer in a second direction through a second conveyance path included in a circulation path along with the first conveyance path. The second conveyance member has a helical second screw around a second shaft. The second conveyance path includes a developer replenishing port and a developer discharge port. The second screw is approximately constant in diameter in a second section being a portion extending a predetermined distance from an end of the discharge port in the second direction when viewed in a top view. The second screw conveys the developer at a lower speed in the second section than on an upstream side with respect to the second section.

9 Claims, 8 Drawing Sheets

(56) References Cited

U.S. PATENT DOCUMENTS

| | | | | |
|---|---|---|---|---|
| 2008/0181672 | A1* | 7/2008 | Hatakeyama ..... | G03G 15/0808 399/254 |
| 2008/0273888 | A1* | 11/2008 | Murata ..... | G03G 15/0849 399/44 |
| 2010/0054765 | A1* | 3/2010 | Murata ..... | G03G 15/0875 399/27 |
| 2010/0067931 | A1* | 3/2010 | Izumi ..... | G03G 15/0877 399/53 |
| 2010/0124442 | A1* | 5/2010 | Hatakeyama ..... | G03G 15/0875 399/254 |

FOREIGN PATENT DOCUMENTS

| | | | |
|---|---|---|---|
| JP | 2002-81787 | | 3/2002 |
| JP | 2004-206088 | | 7/2004 |
| JP | 2009-128754 | | 6/2009 |
| JP | 2009186799 | A * | 8/2009 |
| JP | 2010-230760 | | 10/2010 |

OTHER PUBLICATIONS

Notice of Reasons for Refusal issued in corresponding Japanese Patent Application No. 2014-234920, dated Nov. 22, 2016, with English Translation (6 pages).

* cited by examiner

DEVELOPING DEVICE AND IMAGE FORMING APPARATUS

This application is based on Japanese Patent Application No. 2014-234920 filed on Nov. 19, 2014, the content of which is incorporated herein by reference.

BACKGROUND OF THE INVENTION

1. Field of the Invention

The present invention relates to a developing device employing so-called trickle development technology, and an image forming apparatus including the same.

2. Description of Related Art

Some electrophotographic image forming apparatuses include a trickle developing device which supplies a photoreceptor drum with a two-component developer, which contains carrier and toner, thereby developing an electrostatic latent image formed on a circumferential surface of the photoreceptor drum. In the trickle developing device, a developer container constantly discharges a small and fixed amount of developer, and is replenished with a developer, which includes toner mixed with a small amount of carrier, in accordance with the amount of toner remaining in the developer container.

An example of the trickle developing device is described in Japanese Patent Laid-Open Publication No. 2000-66500. In this developing device, the interior space of the developer container is divided by a partition into first and second developer compartments in which the developer is circulated. The first developer compartment and the second developer compartment respectively include a first conveyance member and a second conveyance member, which are disposed horizontally and have rotating blades in order to convey the developer. Moreover, the first conveyance member is positioned along a developing roller so as to face the developing roller. The second developer compartment has a developer discharge port provided in its top portion. In the second developer compartment, the force of the second conveyance member conveying the developer by the rotating blade is low in some sections positioned on the downstream side with respect to the discharge port. Accordingly, the developer accumulates in such sections, and the upper level of the developer becomes higher than in the other sections.

In Japanese Patent Laid-Open Publication No. 2000-66500, to reduce the conveyance force in the aforementioned sections, the rotating blade of the second conveyance member gradually decrease in diameter toward the downstream side. Accordingly, for example, in the case where the image forming apparatus is installed in an unlevel place, so that the developing device is slanted, some developer accumulating in such sections might flow out of the space between the second conveyance member and the developer container. In such a case, the amount of developer conveyed in the first developer compartment and the second developer compartment varies over time, so that the amount of developer ejected from the discharge port becomes more likely to vary, resulting in reduced image quality.

Furthermore, recent image forming apparatuses might be required to print out more pages per unit time (i.e., increase print speed), or perform printing at various speeds. However, if the speed of developer conveyance is increased or rendered variable in order to meet such requirements, the amount of developer ejected from the discharge port still becomes more likely to vary.

SUMMARY OF THE INVENTION

A developing device according to an embodiment of the present invention includes a developer carrying member, a first conveyance member, and a second conveyance member. The first conveyance member conveys a developer in a first direction through a first conveyance path and supplies the developer to the developer carrying member. The second conveyance member conveys the developer in a second direction through a second conveyance path included in a circulation path along with the first conveyance path. The second conveyance member has a helical second screw around a second shaft. The second conveyance path includes a developer replenishing port. The second conveyance path includes a developer discharge port provided in a top portion. The second screw has an approximately constant diameter in a second section being a portion extending a predetermined distance in the second direction from an end of the discharge port in the second direction when viewed in a top view. The second screw is adapted to be capable of conveying the developer at a lower speed in the second section than on an upstream side with respect to the second section.

In another embodiment of the present invention, an image forming apparatus includes a developing device of the above embodiment.

DETAILED DESCRIPTION OF THE PREFERRED EMBODIMENTS

Figure 1:
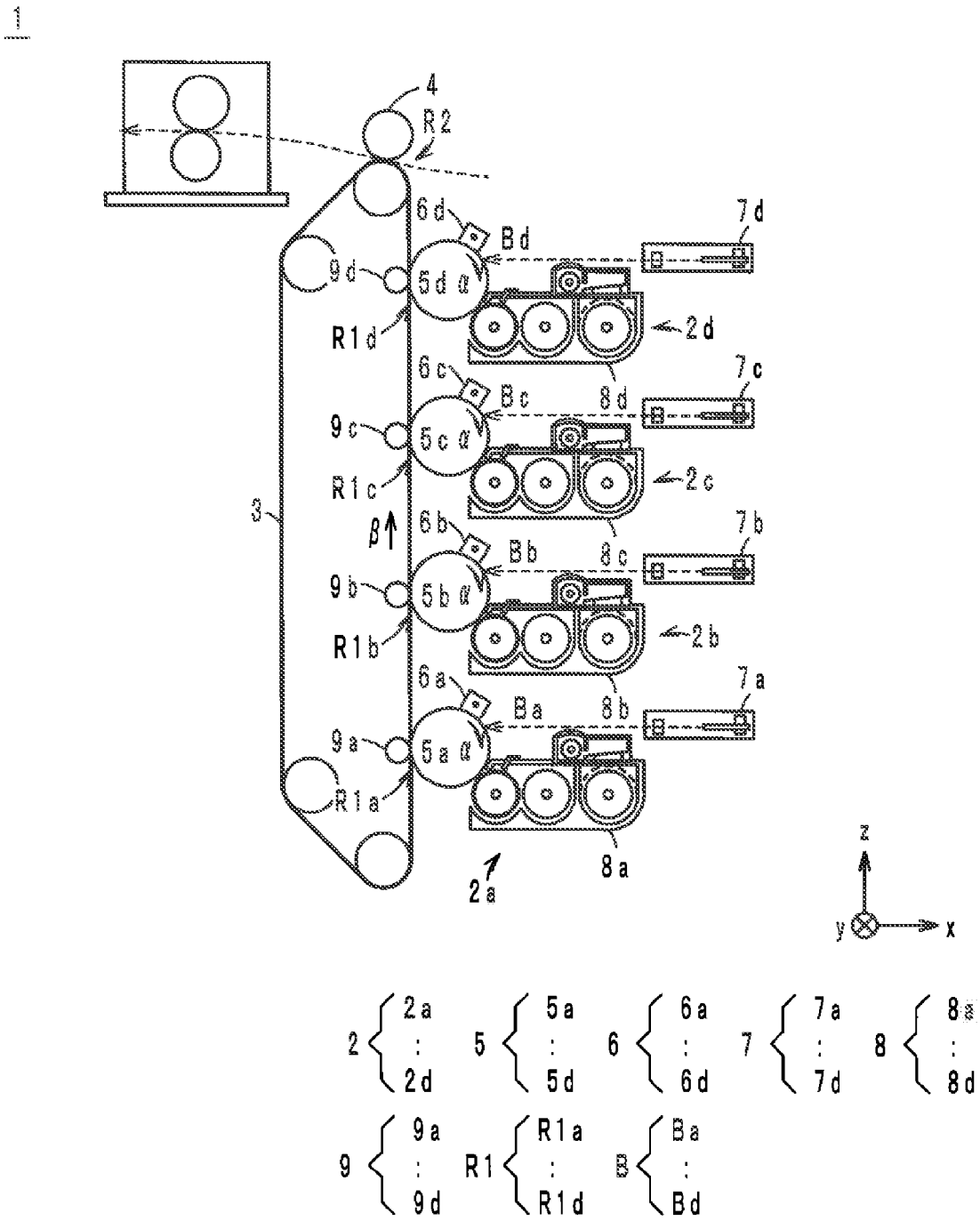
FIG. 1 is a view illustrating a general configuration of an image forming apparatus.

Hereinafter, a toner conveyance member according to an embodiment of the present invention, along with a fuser and an image forming apparatus, will be described in detail with reference to the drawings.

Section 1: Definitions

In some figures, the x-, y-, and z-axes are perpendicular to one another, and represent the right-left, front-back, and up-down direction of the image forming apparatus 1. Moreover, some reference characters herein and also in the drawings are suffixed with the lowercase alphabet letter "a", "b", "c", or "d". The letters "a", "b", "c", and "d" respectively denote yellow (Y), magenta (M), cyan (C), and black (K). For example, the term "photoreceptor drum 5*a*" refers to a photoreceptor drum for yellow. Moreover, any reference character which can be suffixed with such a letter but has no letter added thereto represents one or any of the colors. For example, the term "photoreceptor drum 5" refers to a photoreceptor drum for one or any of the colors Y, M, C, and K.

Section 2: Overall Configuration and Print Operation of Image Forming Apparatus In FIG. 1, the image forming apparatus 1 is, for example, a copier, printer, or fax machine, or a multifunction machine provided with all or some of the functions, and is adapted to print a variety of types of images (e.g., full-color images) on sheets of paper using a tandem system with a well-known electrophotography technology. To this end, the image forming apparatus 1 typically includes imaging units 2, an intermediate transfer belt 3, and a secondary transfer roller 4.

For example, the imaging units 2 for the aforementioned colors are arranged side by side so as to be approximately parallel to the z-axis, and include respective photoreceptor drums 5 for their corresponding colors.

Each photoreceptor drum 5 is in the shape of a column extending in the y-axis direction, and rotates, for example, in the direction of arrow α (referred to below as the "rotational direction α"). Arranged around the photoreceptor drum 5, from upstream to downstream in the rotational direction α, are, at least, a charger 6, a developing device 8, and a primary transfer roller 9.

The charger 6 uniformly charges the circumferential surface of the photoreceptor drum 5 while the photoreceptor drum 5 is rotating.

Provided below the photoreceptor drum 5 is an exposing device 7. The exposing device 7 irradiates an exposure area of the photoreceptor drum 5, which is immediately downstream from the charged area, with an optical beam B based on image data, thereby forming an electrostatic latent image in a corresponding color.

The developing device 8 is a so-called trickle developing device, and supplies a two-component developer for the corresponding color to a developing area R3 (see, for example, FIG. 2A) of the photoreceptor drum 5, which is immediately downstream from the exposure area, thereby forming a toner image in the corresponding color in the developing area R3. The two-component developer herein contains carrier and toner. In the present embodiment, the two-component developer will be referred to below simply as the developer.

The intermediate transfer belt 3 is a so-called endless belt, which is stretched between outer circumferential surfaces of at least two rollers arranged in the up-down direction and rotates, for example, in the direction of arrow β. The outer circumferential surface of the intermediate transfer belt 3 abuts the left end of each photoreceptor drum 5.

The primary transfer roller 9 is positioned opposite to the photoreceptor drum 5 with the intermediate transfer belt 3 positioned therebetween, and presses the inner circumferential surface of the intermediate transfer belt 3 from left, thereby creating a primary transfer area R1 between the photoreceptor drum 5 and the intermediate transfer belt 3. The toner image formed on the photoreceptor drum 5 is transferred to the primary transfer area R1 while the intermediate transfer belt 3 is rotating.

The secondary transfer roller 4 is positioned near the upper end of the intermediate transfer belt 3 so as to press the outer circumferential surface of the intermediate transfer belt 3, thereby creating a secondary transfer area R2 at the contact between the secondary transfer roller 4 and the intermediate transfer belt 3. In the secondary transfer area R2, the image carried on the intermediate transfer belt 3 is transferred to a sheet of paper. The sheet of paper passes through a well-known fuser, and thereafter is ejected into a tray as a print.

Furthermore, the image forming apparatus 1 has cartridges (not shown) provided therein, and each cartridge contains a developer for its corresponding color. The cartridge replenishes its corresponding developing device 8 with the developer when the amount of toner remaining in the developing device 8 decreases to a reference value or lower. Moreover, the cartridge is detachable from the image forming apparatus 1, and therefore, when the cartridge is completely (or nearly) emptied, the cartridge is replaceable with a new cartridge.

Section 3: Details of Configuration and Operation of Developing Device

Figure 2A:
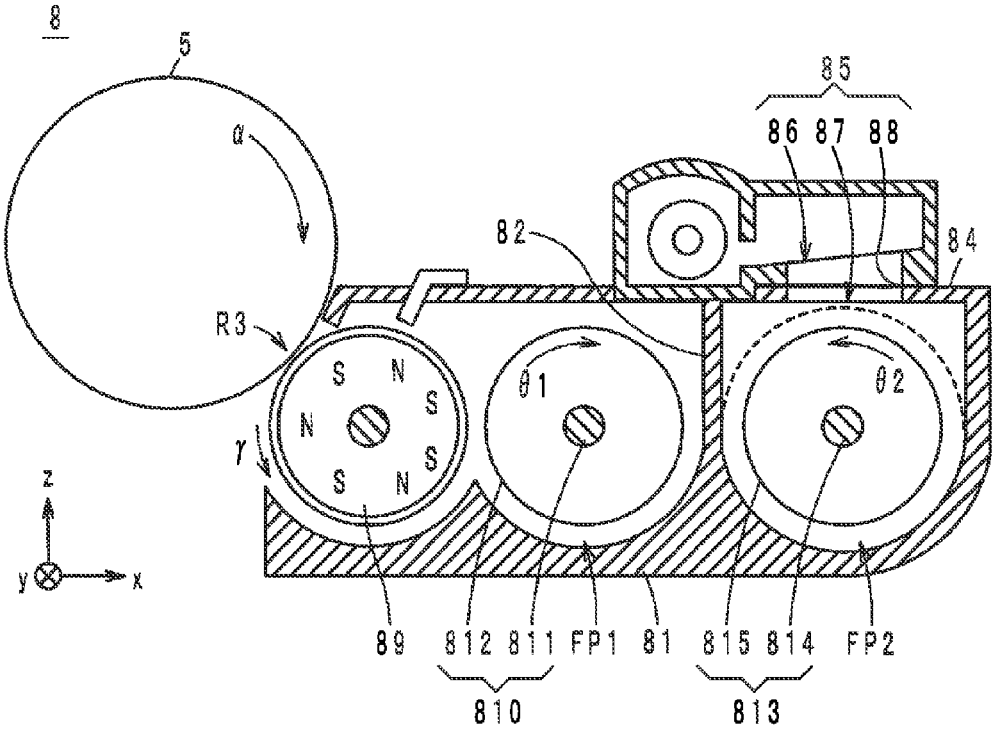
FIG. 2A is a first schematic view illustrating a cross section of a developing device (without a developer) taken along zx plane in FIG. 1.
Figure 2B:
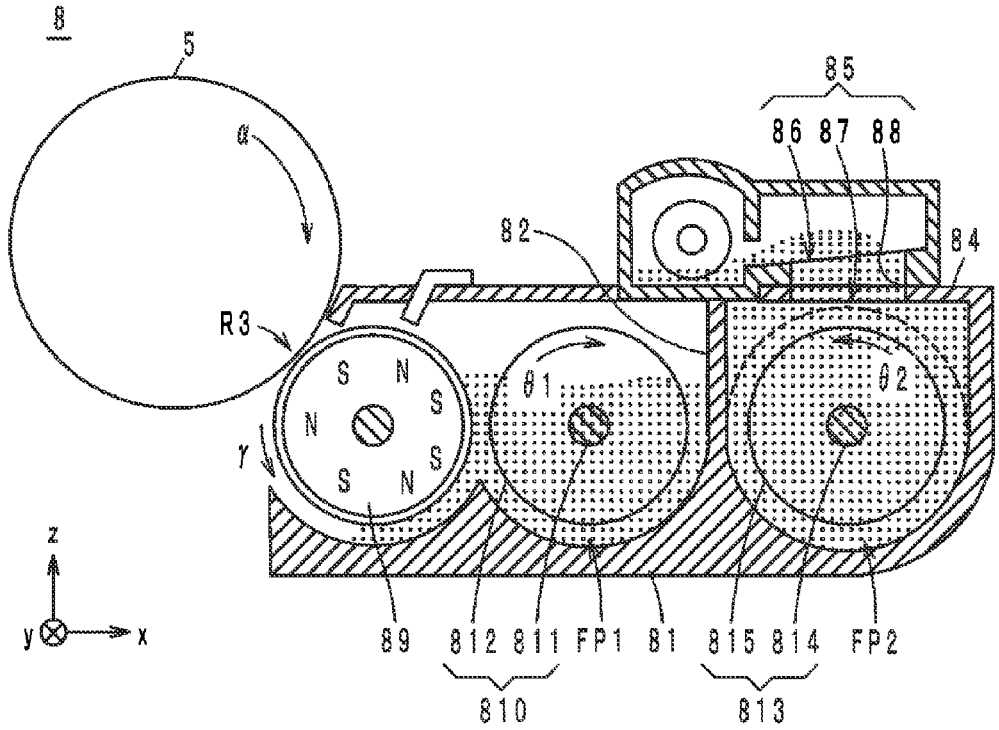
FIG. 2B is a second schematic view illustrating the cross section of the developing device (with a developer) taken along zx plane in FIG. 1.
Figure 3:
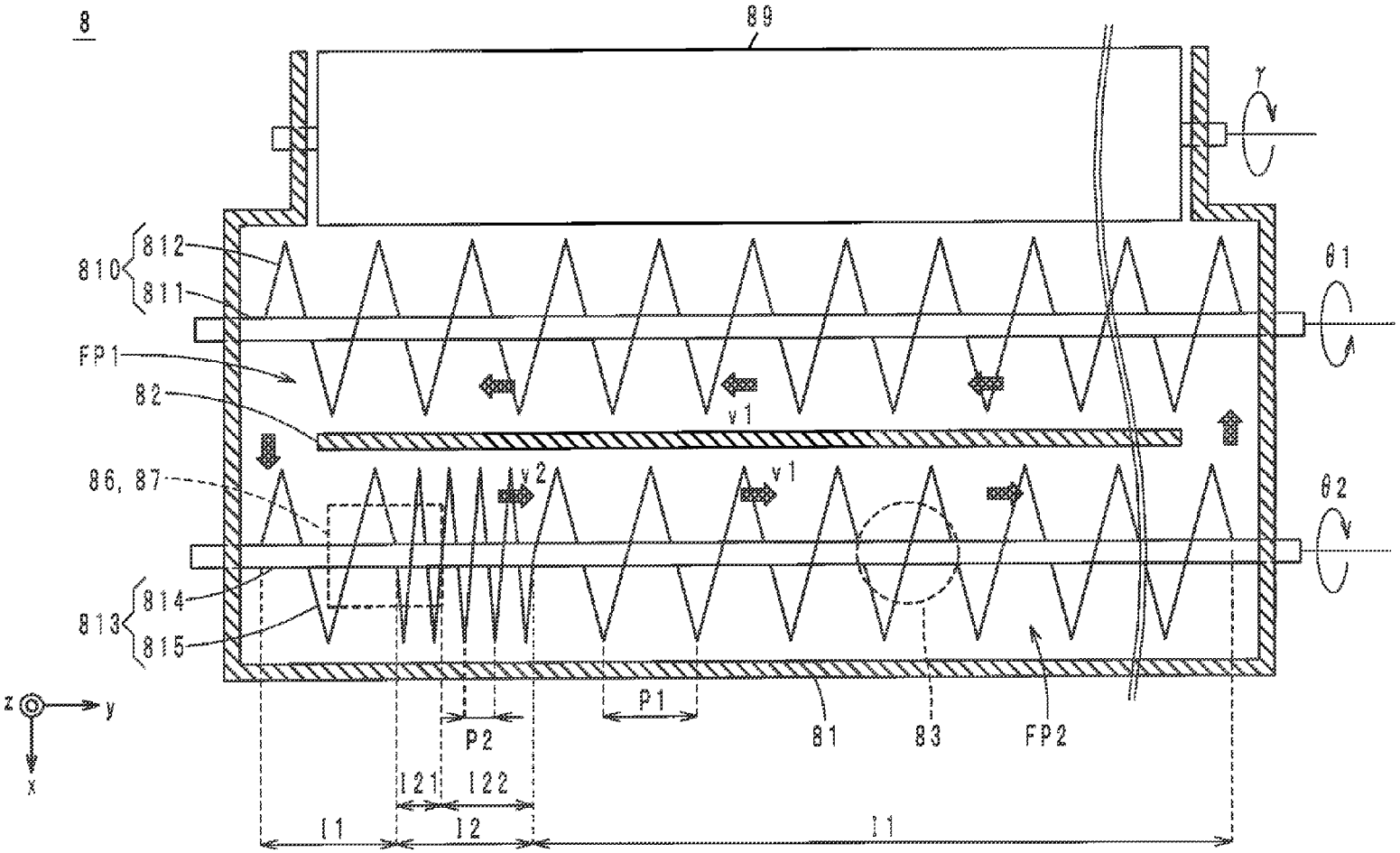
FIG. 3 is a schematic view illustrating a cross section of the developing device taken along xy plane in FIG. 1.
Figure 4:
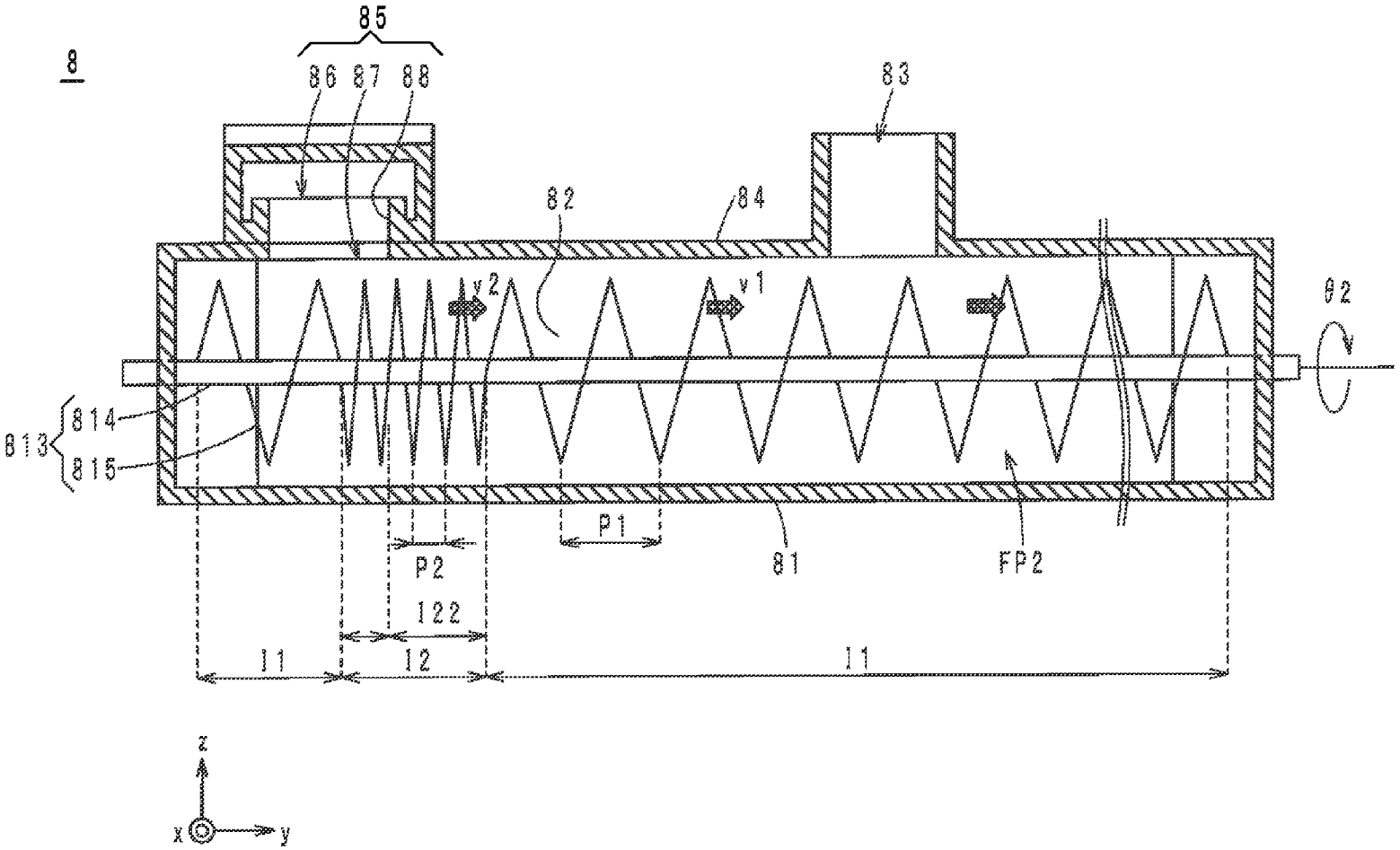
FIG. 4 is a schematic view illustrating a cross section of the developing device taken along yz plane in FIG. 1.

Next, the configuration and the operation of the developing device 8 will be described in detail with reference to FIGS. 2A to 5. Note that for the sake of clarity, FIG. 2A shows no developer, and FIG. 2B shows the developer with dots.

The developing device 8 includes a developer container 81 and a partition 82. The developer container 81 has a developer for its corresponding color stored therein. The developer container 81 extends in the y-axis direction along the photoreceptor drum 5 for the corresponding color, and has an opening at least in a position where the developer container 81 faces the developing area R3.

The partition 82 protrudes upward (in the z-axis direction) from the bottom of the developer container 81, and extends in the y-axis direction. Accordingly, the developer container 81 is divided into a first conveyance path FP1 and a second conveyance path FP2; the first conveyance path FP1 is closer to the photoreceptor drum 5 than is the second conveyance path FP2. Moreover, the conveyance paths FP1 and FP2 communicate with each other in two places whose positions in the y-axis direction are different (e.g., at both ends). This results in a developer circulation path within the developer container 81.

The developing device 8 further includes a replenishing port 83. The replenishing port 83 is an opening provided completely through a top portion 84 of the developer container 81 above the second conveyance path FP2. The replenishing port 83 herein is positioned approximately at the center of the top portion 84 in the y-axis direction. When the density of the toner in the developer container 81 becomes low, the cartridge for the corresponding color supplies a supplementary developer. The developer is introduced into the developer container 81 through the replenishing port 83. Note that a well-known density sensor utilizing magnetic permeability detection is used to detect the toner density.

The developing device 8 further includes a cylindrical buffer portion 85 protruding upward from the top portion 84. The buffer portion 85 is preferably provided on the negative side in the y-axis direction with respect to the replenishing port 83 (i.e., on the upstream side in the developer conveyance direction). More specifically, the buffer portion 85 includes a discharge port 86 provided at the top (i.e., the discharge port 86 is positioned higher than the top of the second conveyance path FP2), and an opening 87 provided at the bottom. When viewed in a plan view from the positive side in the z-axis direction (referred to below as "in a top view"), it is preferable that the discharge port 86 and the opening 87 completely overlap with each other. Moreover, the discharge port 86 and the opening 87 are connected at their outer edges by at least one side surface 88. Accordingly, the discharge port 86 communicates with the second conveyance path FP2. The space enclosed by the side surface 88 holds a portion of the developer in the second conveyance path FP2, and a portion of the developer held in the space enclosed by the side surface 88 overflows from the discharge port 86 as an excess developer. The excess developer flows out of the buffer portion 85 along a slanted surface of the discharge port 86 and is forced out of the developing device 8.

The developing device 8 also includes a developing roller 89, which is a typical example of a developer carrying member. The developing roller 89 has receiving poles and developing poles arranged in fixed positions within a rotatable sleeve. Moreover, the developing roller 89 is disposed so as to be approximately parallel to the photoreceptor drum 5 for the corresponding color, and proximal to the developing area R3 for the corresponding color, and further, the developing roller 89 spans from one side to the other within the developer container 81 and is rotatable in the direction of arrow γ. The developing roller 89 receives the developer from a first conveyance member 810, which will be described later, at the receiving pole, and carries the developer on its outer circumferential surface. Thereafter, the developing roller 89 rotates to convey the developer on the outer circumferential surface to the developing pole, and then supplies the developer to the developing area R3 of the photoreceptor drum 5.

The developing device 8 further includes the first conveyance member 810. The first conveyance member 810 is disposed to the right of the developing roller 89 in the first conveyance path FP1 so as to be approximately parallel to and proximal to the developing roller 89, and further, the first conveyance member 810 spans from one side to the other in the first conveyance path FP1 and is supported about an axis so as to be rotatable in the direction of arrow θ1. Through rotation, the first conveyance member 810 supplies the developer to the receiving pole of the developing roller 89, and also conveys the developer in the first conveyance path FP1 in a first direction (i.e., in the opposite direction to the y-axis direction) while stirring the developer. Once the developer is conveyed to the end of the first conveyance path FP1 in the first direction (i.e., the starting end in the y-axis direction), the developer flows into the second conveyance path FP2 through the communicating portion. Note that the directions in which the developer is carried in the conveyance paths FP1 and FP2 are indicated by hatched arrows in the figures.

Described next is a configuration example of the first conveyance member 810. The first conveyance member 810 is made from, for example, a resin by injection forming or suchlike. The first conveyance member 810 at least includes a first shaft 811 and a first screw 812. The first shaft 811 is a rotational shaft extending in the first direction, and rotates clockwise, as indicated by arrow θ1, when viewed in a plan view from the negative side in the y-axis direction. The first screw 812 is a bladed member winding around the outer circumferential surface of the first shaft 811 in the clockwise direction θ1 (also referred to simply as the "direction θ1"), and the bladed member continues to extend helically in the first direction, from the positive end to the negative end of the first shaft 811 in the y-axis direction.

The developing device 8 further includes a second conveyance member 813. The second conveyance member 813 is disposed in the second conveyance path FP2 so as to be approximately parallel to the first conveyance member 810 with the partition 82 positioned therebetween, and further, the second conveyance member 813 spans from one side to the other in the second conveyance path FP2 and is supported about an axis so as to be rotatable in the direction of arrow θ2. Through rotation, the second conveyance member 813 conveys the developer in the second conveyance path FP2 in a second direction while stirring the developer, so that the developer flows from the second conveyance path FP2 into the first conveyance path FP1 through the communicating portion. Note that the second direction herein is the opposite direction to the first direction.

The second conveyance member 813 has a similar configuration to the first conveyance member 810. Specifically, the second conveyance member 813 includes at least a second shaft 814 and a second screw 815. The second shaft 814 is a rotational shaft extending in the second direction and having approximately the same thickness across the entire length in the y-axis direction. Moreover, the second shaft 814 rotates counterclockwise, as indicated by arrow θ2, when viewed in a plan view from the negative side in the y-axis direction. The second screw 815 is a bladed member winding around the outer circumferential surface of the second shaft 814 in the counterclockwise direction θ2 (also referred to simply as the "direction θ2"), and the bladed member continues to extend helically in the second direction, from the negative end to the positive end of the second shaft 814 in the y-axis direction.

The second conveyance member 813 has a second section I2 as defined in the following. The second section I2, when viewed in a top view, includes a portion I21 and a portion I22; the portion I21 extends from an arbitrary position on the second screw 815 which falls within the boundary of the discharge port 86 to the end of the discharge port 86 in the second direction, and the portion I22 extends a predetermined distance in the second direction from the end of the discharge port 86 in the second direction. Assuming here that the portion I22 and the discharge port 86 respectively have lengths L22 and L86 in the second direction, the length L22 is designed to be about a half of the length L86. Moreover, the second conveyance path FP2 is designed to have approximately the same shape (preferably, circular) at least in the second section I2 if the second conveyance path FP2 is cut approximately parallel to the zx plane at any position in the y-axis direction.

Furthermore, the rest of the second screw 815, excluding the second section I2, is defined herein as a first section I1.

Assuming here that the screw pitch of the first section I1 and the screw pitch of the second section I2 are a first pitch P1 and a second pitch P2, respectively, the pitch P1 is designed to be wider than the pitch P2. Also, assuming that the developer conveyance velocity is a first velocity v1 in the first section I1 and also a second velocity v2 in the second section I2, the pitches P1 and P2, and other design values, are determined such that the velocity v2 is lower than the velocity v1. More preferably, the value of v2/v1, which is the ratio of the second velocity v2 to the first velocity v1, falls within the range from 0.3 to 0.5.

Furthermore, herein, the diameter of the second screw 815 is approximately constant at least in the second section I2.

Figure 5:
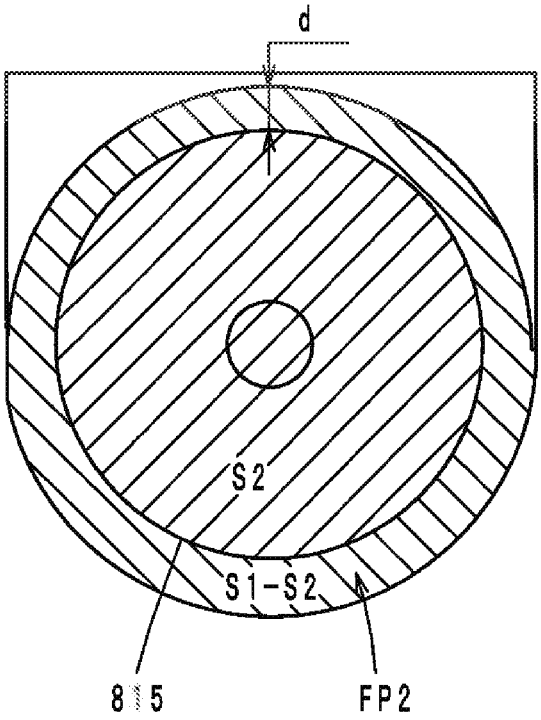
FIG. 5 is a schematic view illustrating the relationship between the cress-sectional area of a second screw and the cress-sectional area of a second conveyance path in a second section.

Accordingly, the distance d between the top portion 84 and each blade edge of the second screw 815 in the second section I2 is approximately constant. Here, the distance d is preferably designed to be as short as possible. More specifically, when viewed in a plan view in the second direction (i.e., the y-axis direction), as shown in FIG. 5, the second conveyance path FP2 has an area S1 in the second section I2, and the second screw 815 has an area S2 within its outer edge in the second section I2, the value of (S1−S2)/S2, which is the ratio of the area (S1−S2) to the area S2, is preferably designed to be less than 1. However, the second screw 815 and the second conveyance path FP2 are only required to be designed such that the ratio (S1−S2)/S2 falls within the range from 0.2 to 0.4.

Section 4: Actions and Effects of Developing Device

Figure 6:
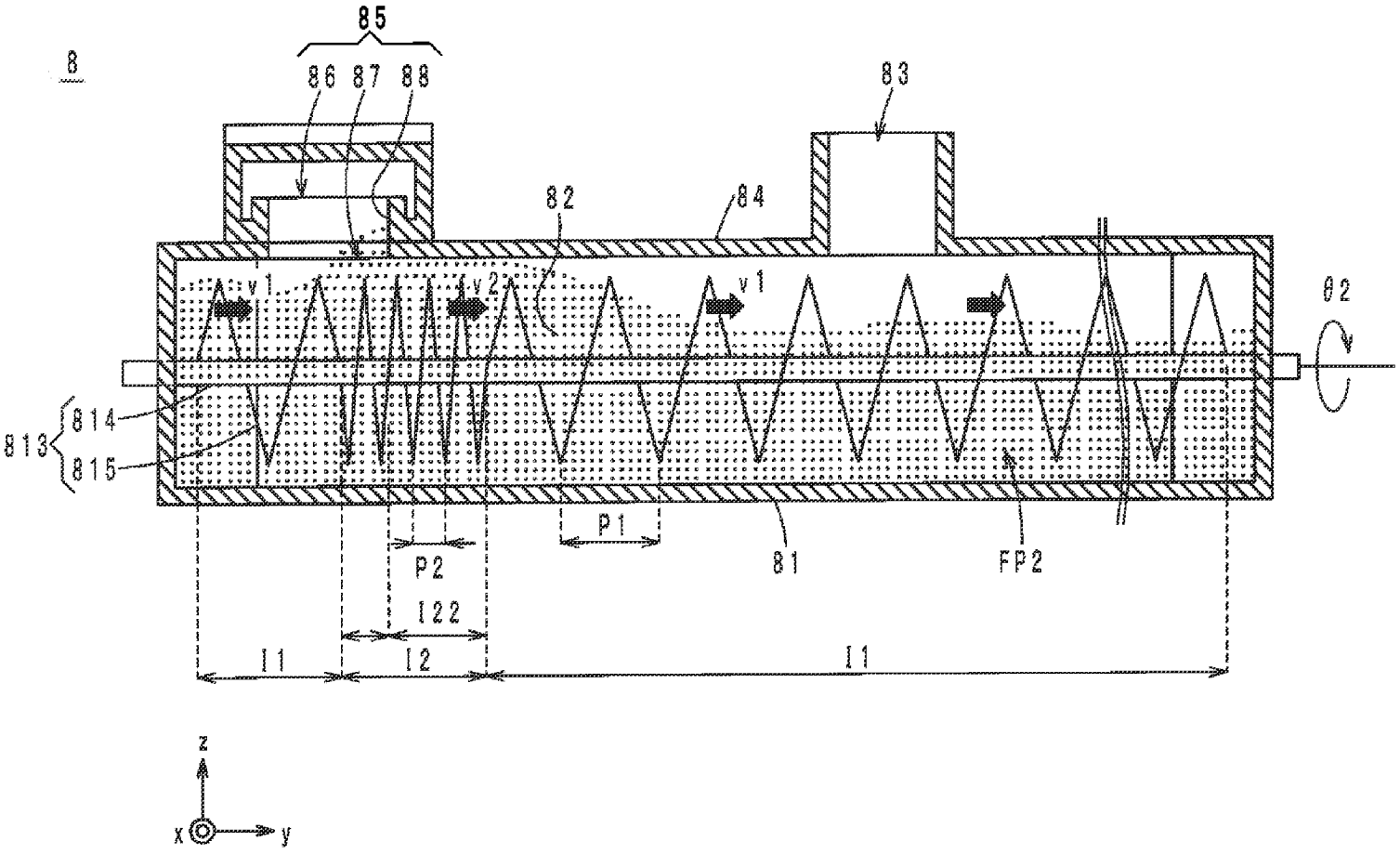
FIG. 6 is a schematic view illustrating the state of the developer, as shown in, for example, FIG. 2B, in the second conveyance path.

In the developing device 8 configured as above, the conveyance members 810 and 813 respectively rotate in the directions θ1 and θ2 during a print operation, so that the developer is circulated through a circulation path including the conveyance paths FP1 and FP2. During the course of the circulation, the developer flows into the second conveyance path FP2 and is conveyed at the first velocity v1, which is relatively high, to the second section I2 of the second conveyance member 813. In the second section I2, the developer is conveyed at the second velocity v2, which is low compared to the conveyance velocity on the upstream side with respect to the second section I2, and therefore, the surface of the developer is swollen and held in part within the buffer portion 85, as shown in FIG. 6. Even during this period, the developer continues to flow into the second section I2, so that the developer in the buffer portion 85 overflows in part from the discharge port 86, and is forced out of the developing device 8. Note that when the amount of developer in the developer container 81 becomes low during the print operation, a supplementary developer is supplied, as described earlier.

Furthermore, the second section I2 includes the portion I22, which, when viewed in a top view, extends a distance equivalent to the length L22 in the second direction from the end of the discharge port 86 in the second direction. In the portion I22 also, the screw pitch is the second pitch P2, which is relatively narrow. Accordingly, in the portion I22 also, the developer is conveyed at the second velocity v2, which is low. More specifically, the ratio v2/v1 is designed to fall within the range from 0.3 to 0.5, and the length L22 is designed to be about a half of the length L86, as described above. The distance d between the blade edge of the second screw 815 and the top portion 84 is designed as short as possible. With the above configuration, it is rendered possible to hold the developer within the buffer portion 85 while filling the portion I22 of the second conveyance path FP2 with the developer, and therefore, even if the developing device 8 is slanted, or the developer conveyance velocity is high and/or variable, the developer held within the buffer portion 85 can be prevented from undesirably flowing into the portion I22. Accordingly, the amount of developer conveyed in the second conveyance path FP2 on the downstream side with respect to the second section I2 can always be approximately uniform, whereby the amount of developer conveyed in the circulation path can be inhibited from varying. Thus, naturally, the amount of developer ejected from the discharge port 86 can be inhibited from varying, whereby it is rendered possible to suppress image quality reduction.

Section 5: Supplementary 1

In the above preferred example, the second section I2 includes the portions I21 and I22. However, this is not limiting, and the second section I2 may simply include the portion I22, which extends a predetermined distance in the second direction from the end of the discharge port 86 in the second direction.

Furthermore, in the above preferred example of holding the developer, the buffer portion 85 protrudes from the top portion 84, such that the discharge port 86 is positioned higher than the top portion 84. However, this is not limiting, and the discharge port 86 of the buffer portion 85 may be an opening provided completely through the top portion 84. That is, the distance between the discharge port 86 and the opening 87 may be essentially equal to the thickness of the top portion 84.

Section 6: First Modification

Figure 7:
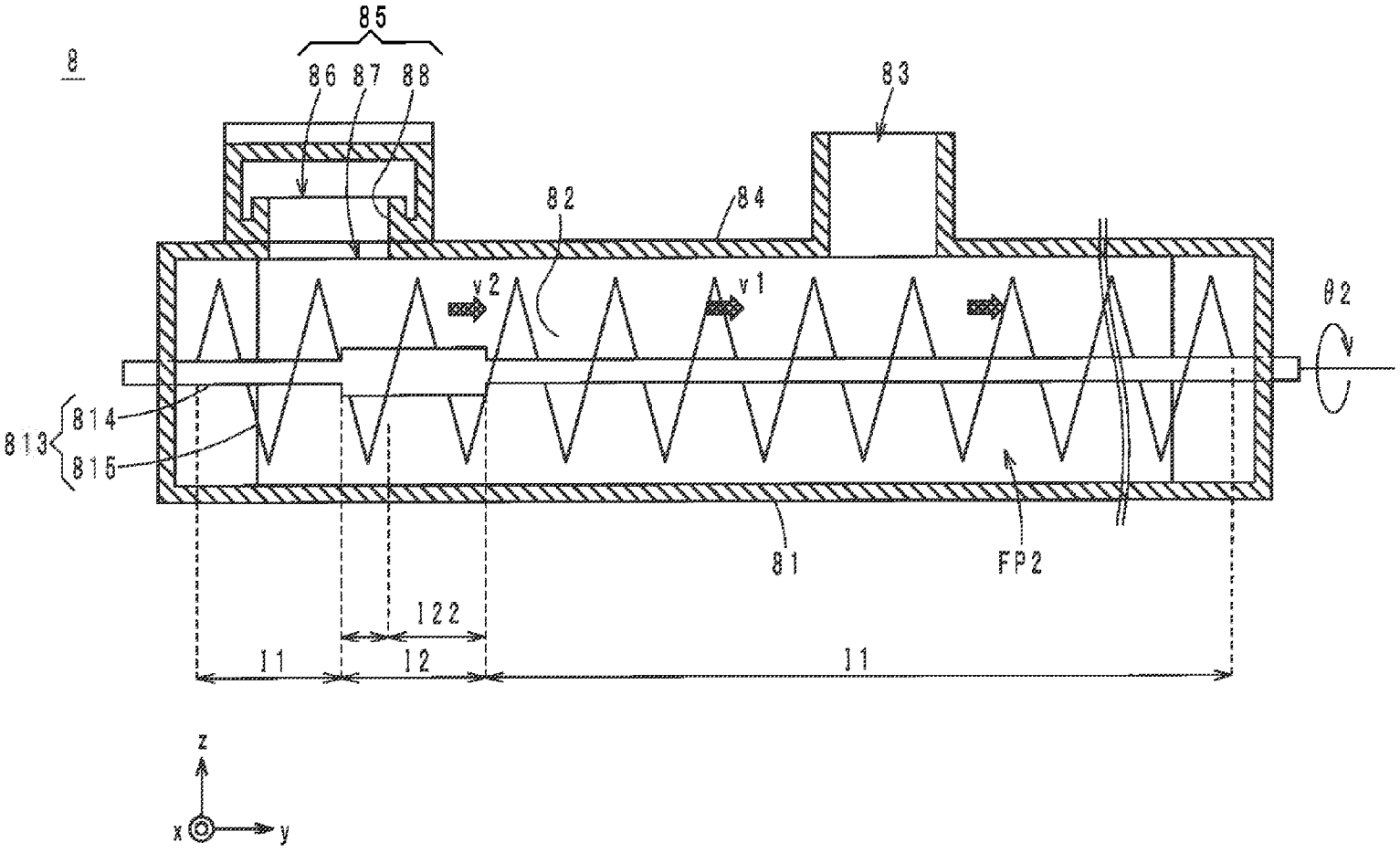
FIG. 7 is a schematic view illustrating the configuration of a developing device according to a first modification.

In the foregoing, the screw pitch of the first section I1 and the screw pitch of the second section I2 are respectively set to be the first pitch P1 and the second pitch P2, so that the developer conveyance velocity varies between the first section I1 and the second section I2. However, this is not limiting, and the developer conveyance velocity may be adjusted by setting both the diameter and the pitch of the second screw 815 to be equal between the first section I1 and the second section I2 while making the second shaft 814 thicker in the second section I2 than in the first section I1, as shown in FIG. 7.

Section 7: Second Modification

Figure 8:
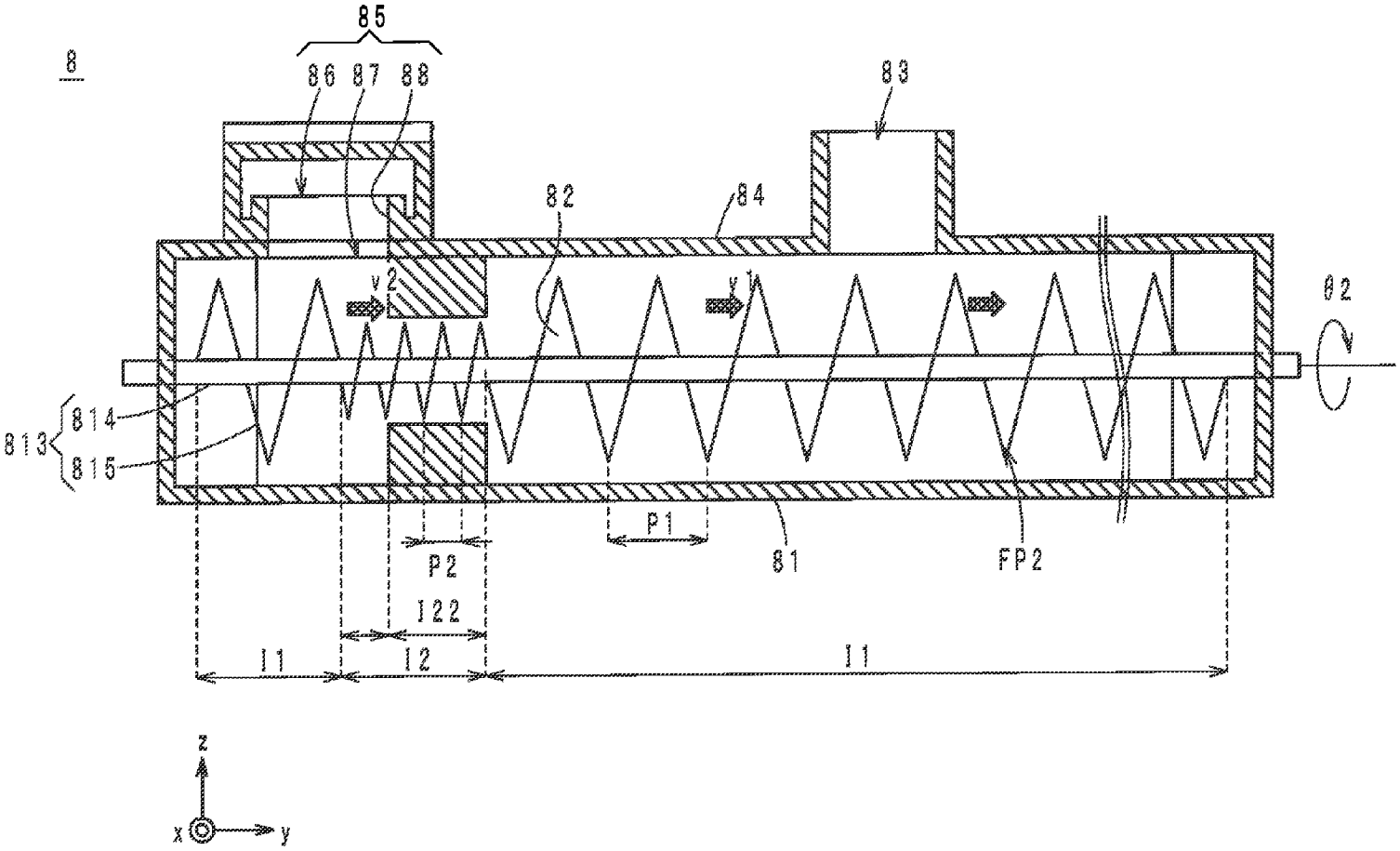
FIG. 8 is a schematic view illustrating the configuration of a developing device according to a second modification.

The developer conveyance velocity can also be adjusted as shown in FIG. 8. Specifically, the screw pitch of the first section I1 and the screw pitch of the second section I2 are respectively designed to be the first pitch P1 and the second pitch P2, as described above. The thickness of the second shaft 814 is designed to be equal between the first section I1 and the second section I2. However, both the diameter of the second screw 815 and the diameter of the second conveyance path FP2 may be designed to be smaller in the second section I2 than in the first section I1. Note that it is preferable that the configuration shown in FIG. 8 also satisfies the relationship between the areas S1 and S2 shown in FIG. 5.

Although the present invention has been described in connection with the preferred embodiment above, it is to be noted that various changes and modifications are possible to those who are skilled in the art. Such changes and modifications are to be understood as being within the scope of the invention.

What is claimed is:

1. A developing device comprising:

a developer carrying member;

a first conveyance member conveying a developer in a first direction through a first conveyance path and supplying the developer to the developer carrying member;

a top wall extending parallel with the first direction; and a second conveyance member conveying the developer in a second direction through a second conveyance path included in a circulation path along with the first conveyance path, the second conveyance member having a helical second screw around a second shaft, wherein, the second conveyance path includes a developer replenishing port, and the second conveyance path includes a developer discharge port from which the developer is discharged out of the developing device, the developer discharge port including an opening through the top wall, and the second screw has a constant diameter in a second section being a portion extending a predetermined distance in the second direction from an end of the discharge port in the second direction when viewed in a top view, the second screw being configured to convey the developer at a lower speed in the second section than on an upstream side of the second section, wherein the second conveyance path and the second screw are configured such that, during operation of the developing device, developer is backed up in the second conveyance path upstream of the second section such that the backed up developer is forced into the developer discharge port.

2. The developing device according to claim 1, wherein the discharge port is positioned higher than the second conveyance path and communicates with the second conveyance path.

3. The developing device according to claim 1, wherein S1 and S2 satisfy (S1−S2)/S2<1, where S1 is the area of the second conveyance path in the second section when viewed in the second direction, and S2 is the area of the second screw in the second section when viewed in the second direction.

4. The developing device according to claim 3, wherein (S1−S2)/S2 falls within the range from 0.2 to 0.4.

5. The developing device according to claim 1, wherein the second section of the second screw, when viewed in a top view, further includes a portion extending from a position enclosed within the discharge port to the end of the discharge port in the second direction.

6. The developing device according to claim 1, wherein the second screw has a narrower pitch in the second section than on the upstream side with respect to the second section.

7. The developing device according to claim 1, wherein, the second shaft is thicker in the second section than on the upstream side with respect to the second section, and the diameter of the second screw is constant both in the second section and on the upstream side with respect to the second section.

8. The developing device according to claim 1, wherein, the second conveyance path, when viewed in a plan view in the second direction, has a smaller area in the second section than on the upstream side with respect to the second section, the second screw has a smaller diameter in the second section than on the upstream side with respect to the second section, and the second conveyance path has an inner surface spaced apart from an outer edge of the second screw at the same distance both in the second section and on the upstream side with respect to the second section.

9. An image forming apparatus comprising the developing device according to claim 1.

* * * * *